United States Patent [19]

Henningsen

[11] 4,449,343

[45] May 22, 1984

[54] INSULATION SUSPENSION SYSTEM

[76] Inventor: Dennis N. Henningsen, Highway 18 East, P.O. Box 310, Mason City, Iowa 50401

[21] Appl. No.: 374,341

[22] Filed: May 3, 1982

[51] Int. Cl.[3] ..... E04B 1/74; E04B 5/55

[52] U.S. Cl. ..... 52/404; 52/39; 52/484

[58] Field of Search ..... 52/404, 483, 484, 486, 52/489, 714, 716, 664, 665–669, 28, 39

[56] References Cited

U.S. PATENT DOCUMENTS

| | | | |
|---|---|---|---|
| 4,041,657 | 8/1977 | Schuplin | 52/39 |
| 4,044,521 | 8/1977 | Fischer et al. | 52/404 |
| 4,047,345 | 9/1977 | Alderman | 52/404 |
| 4,117,641 | 10/1978 | Wells | 52/404 |
| 4,251,972 | 2/1981 | Interlante | 52/404 X |
| 4,263,763 | 4/1981 | Bouwens | 52/404 |
| 4,333,291 | 6/1982 | Musgrave et al. | 52/404 |
| 4,375,741 | 3/1983 | Paliwoda | 52/404 X |
| 4,375,742 | 3/1983 | Paliwoda | 52/404 |
| 4,384,437 | 5/1983 | Coles | 52/404 |
| 4,391,075 | 7/1983 | Musgrave | 52/484 X |

*Primary Examiner*—J. Karl Bell

*Attorney, Agent, or Firm*—Zarley, McKee, Thomte, Voorhees & Sease

[57] ABSTRACT

The insulation suspension system of the present invention provides means for supporting insulation between parallel purlins of a building roof. The system comprises a plurality of support members which are arranged in parallel spaced apart relationship adjacent the lower edges of the purlins. The support members extend transversely to the purlins and span the distance between the purlins. A clip is used to attach each end of the support members to the purlins. The support members hold the batt insulation between the purlins so that the bottom edges of the purlins are exposed to the interior of the building.

6 Claims, 4 Drawing Figures

INSULATION SUSPENSION SYSTEM

BACKGROUND OF THE INVENTION

This invention relates to an insulation suspension system for a roof having a plurality of elongated purlins on the undersurface thereof.

Providing insulation for the roofs and ceilings of newly constructed buildings is a relatively simple matter. However, when it is desired to insulate a building which is already in existence, certain unique problems are encountered.

The normal method for insulating the roof of a building having a plurality of purlins extending downwardly therefrom is to pack insulation batting into the space between the purlins. The insulation is usually extended downwardly below the lower edges of the purlins so that when the insulation is complete, the purlins are completely covered up by the insulation and are not exposed to the interior of the building.

In buildings which are already in existence, this prior method of insulating is difficult to do. Usually the electrical conduit and the electrical appliances such as fans, lights, etc. for the building, are mounted on the undersurfaces of the purlins. When the insulation covers the undersurfaces of the purlines, it is necessary to make special provision for these appliances which extend downwardly therefrom. This is a time-consuming task, and makes the job of insulating a presently existing building considerably more expensive and inefficient.

Therefore, a primary object of the present invention is the provision of an improved insulating suspension system for building roofs.

A further object of the present invention is the provision of an improved system wherein the undersurfaces of the purlins are left exposed to the interior of the building so that there is a minimum of interference with the conduits and electrical appliances which are attached to the undersurfaces of the purlins.

A further object of the present invention is the provision of an insulation suspension system which can be installed quickly and easily with a minimum of time and effort.

A further object of the present invention is the provision of an insulation suspension system which requires a minimum of tools in order to be installed.

A further object of the present invention is the provision of a suspension system which is economical in manufacture, durable in use and efficient in operation.

SUMMARY OF THE INVENTION

The present invention utilizes a suspension system which includes a plurality of support members which extend between the purlins in a direction transverse to the longitudinal axis of the purlins. The support members are attached to the bottom edges of the purlins by means of a clip which holds the support member so that the upper edge of the support member is in close proximity to the lower edges of the purlins. The insulation batting is supported by the cross-support members so that all of the insulation is between the purlins and so that the bottom surface of the insulation is in approximately the same plane as the lower surfaces of the purlins. In this arrangement, the lower surfaces of the purlins are exposed between the sheets of insulation, and the appliances which are suspended from the lower surfaces of the purlins remain undisturbed.

The present invention permits the insulation to be installed without disturbing any of the fans, lights, or conduit which are fastened to the undersurfaces of the purlins. This simplifies and speeds up the process of installing the insulation since it is not necessary to cut and fit around the various appliances and conduit.

DETAILED DESCRIPTION OF PREFERRED EMBODIMENT

Figure 1:
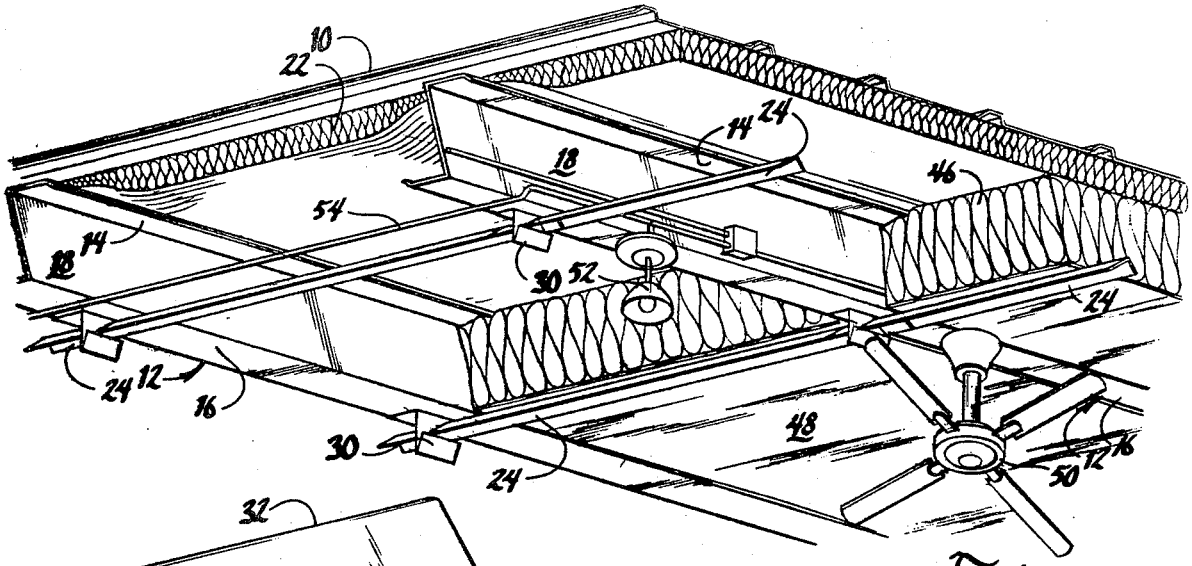
FIG. 1 is a perspective view showing the suspension system mounted on the undersurface of a roof.
Figure 2:
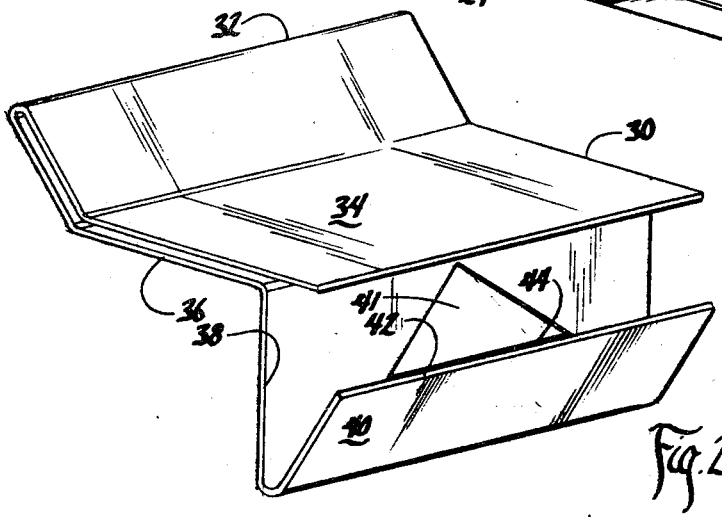
FIG. 2 is a perspective view of the clip used to attach the support members to the purlins.

Referring to the drawings, the numeral 10 generally designates the existing roof panel of a building. The roof panel is supported by a plurality of purlins 12 which extend parallel to one another in spaced apart relation. This use of purlins is conventional in many types of building construction, particularly in the construction of metal buildings. In cross-section, each purlin includes an upper horizontal flange 14 and a lower horizontal flange 16, which are joined together by a vertical upstanding web 18. The outer edges of horizontal flanges 14, 16 are each provided with a canted edge 20.

Interposed between purlins 12 and roof panel 10 is a layer of exisitng fiberglass batt insulation 22 which is conventionally applied to most buildings. In buildings that have been constructed in prior years, this insulation is insufficient in thickness to provide adequate insulation in view of increasing fuel costs. Accordingly, in many presently existing buildings, it is desirable to supplement insulation 22 with an additional thicker layer of batt insulation.

The present invention provides this additional insulation by utilizing a plurality of elongated support members 24. Support members 24 may be of any desired cross-sectional configuration, but the preferred configuration utilizes an angle construction having in cross-section a pair of angle legs 26, 28 which are at an approximate right angle with respect to one another.

Figure 3:
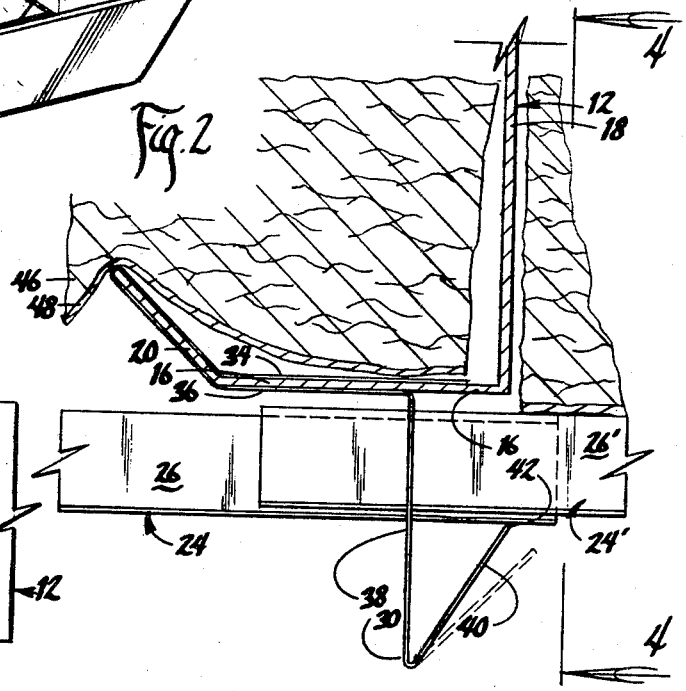
FIG. 3 is a sectional view showing the clip mounted on the purlin with the support member and insulation in place.

Support members 24 are suspended from purlins 12 by means of a plurality of clips 30. Each clip 30 includes a clamp portion 32 comprising an upper plate 34 and a lower plate 36, which are folded back over upon one another in spaced apart relation so that they will conform to and embrace the upper and lower surfaces of the horizontal flanges 20 of purlins 12, as can be seen in FIG. 3. Because these plates 34, 36 conform to the horizontal flange 16 and the canted edge 20 thereof, they hold the clip 30 against any movement with respect to the purlin when they are clamped on the purlin as shown in FIG. 3.

Extending downwardly from lower plate 36 is a vertical plate 38, and extending upwardly at an angle with respect to plate 38 is a securing flap 40. Vertical plate 38 is provided with a triangular cut-out 42, which is sized to conform to the cross-sectional configuration of support member 24. The size of cut-out 42 is sufficiently large to receive two support members 24 which are nested together in the manner shown in FIGS. 3 and 4.

Figure 4:
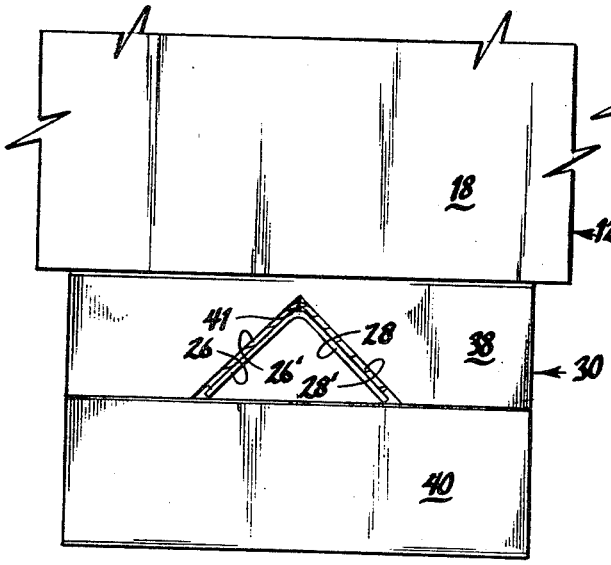
FIG. 4 is a sectional view taken along line 4—4 of FIG. 3.

This permits the angle members to be nested within one another adjacent their ends so as to provide a continuous extension thereof. Thus, each clip supports the adjacent ends of two support members in the overlapped nested relation such as shown in FIGS. 3 and 4. Referring to FIG. 4 the angle legs of the exterior nested support member 24 are designated by the numerals 26' and 28'.

Securing flap 40 includes an upper edge 42 which is initially a slight distance below the triangular base 44 of opening 42. After support member 24 is inserted through opening 42, upper edge 42 of securing flap 40 is bent inwardly and upwardly as shown in FIG. 3. Securing flap 40 is preferably made of metal which is capable of being bent upwardly into frictional engagement with support member 24, and because of this frictional engagement, it holds support member 24 against sliding movement within opening 42. Thus, securing flap 40 helps hold the support members against movement when they are mounted within the clip 30.

Supported by the support members 24 is a sheet of new fiberglass batt insulation 46 having a vapor barrier 48 on the lower surface thereof. The insulation 46 fits between the vertical webs 18 of the purlins 12, and the vapor barrier 48 extends above horizontal flanges 16 of purlins 12, as shown in FIGS. 1 and 3. This causes the lower surfaces of horizontal flanges 16 to be completely exposed to the interior of the room after installation of the system. The clips 30 hold the support members closely adjacent the under surfaces of horizontal flanges 16 so as to support the insulation between the purlins. However, as can be seen in FIG. 1, implements such as fan 50 or light 52, or conduit 54, do not interfere with the installation of the insulation. Furthermore, the insulation does not have to be cut around these appliances, nor do the appliances have to be removed in order to install the insulation.

The clips of the present invention may be installed quickly and do not require any special tools. They may be manually clipped on the lower edges of the purlins and the cross-members 24 fitted therein. All that is necessary then is to insert the insulation so that it is supported by the cross-members.

Thus, it can be seen that the device accomplishes at least all of its stated objectives.

What is claimed is:

1. An insulation suspension system for a roof having a plurality of elongated purlins on the under surface of said roof, said purlins having longitudinal axes extending in parallel spaced relation to one another, each of said purlins having in cross-section an upstanding web and a horizontal flange connected to the bottom edge of said web, said horizontal flange having a downwardly presented surface, at least one electrical appliance connected to said downwardly presented surface and protruding downwardly therefrom; said system comprising:

a plurality of elongated parallel support members extending transversely to the longitudinal axes of said purlins and spanning the space between said spaced apart purlins, clip means operatively attached to said purlins and retentively engaging said support members at opposite ends thereof so as to hold said support members in close proximity to said downwardly presented surfaces of said purlins, a sheet of insulation material filling the space between said webs of said spaced apart purlins, said sheet having a downwardly presented surface which is positioned approximately in the same horizontal plane as said horizontal flange and which is fitted above said horizontal flange so as to leave said downwardly presented surface and said downwardly protruding appliance exposed from below;

said support members underlying and providing support to said sheet of insulation between said purlins.

2. An insulation system according to claim 1 wherein said clip means comprises a substantially vertical wall member having an upper edge adjacent said purlin and a lower edge extending downwardly therefrom, said vertical wall member having a support receiving opening therein sized and shaped to conform to the cross-sectional size and shape of one of said support members, one of said support members extending through said opening.

3. An insulation system acording to claim 2 wherein said opening is triangular in shape and said support members are angle members.

4. An insulation system according to claim 3 wherein a first one of said support members has one of its ends extending through said opening in a first direction and a second one of said support members has one of its ends slidably mated within said one end of said first member and also extending through said opening in a second direction opposite to said first direction, whereby said first and second suport members form a continuation of one another extending from opposite sides of said purlins.

5. An insulation system according to claim 2 wherein said clip means further comprises securing means frictionally retentively engaging said support member and holding said support member against longitudinal sliding movement within said opening.

6. An insulation system acording to claim 5 wherein said securing means comprises a securing flange attached to said lower edge of vertical wall member and extending upwardly therefrom, said securing flange having an upper edge frictionally engaging said support member.

* * * * *